United States Patent [19]

Thokar et al.

[11] 4,149,878

[45] Apr. 17, 1979

[54] USE OF ARGON TO PREPARE LOW-CARBON STEELS BY THE BASIC OXYGEN PROCESS

[75] Inventors: Henry D. Thokar, Aurora, Ohio; James S. Adams, Grosseile, Mich.; Paul A. Tichauer, Chappaqua, N.Y.

[73] Assignees: Union Carbide Corporation, New York, N.Y.; National Steel Corporation, Pittsburgh, Pa.

[21] Appl. No.: 880,562

[22] Filed: Feb. 23, 1978

Related U.S. Application Data

[63] Continuation of Ser. No. 758,408, Jan. 11, 1977, abandoned.

[51] Int. Cl.[2] ..... C21C 7/10; C21C 7/00

[52] U.S. Cl. ..... 75/60; 75/49; 75/59

[58] Field of Search ..... 75/59, 60, 49

[56] References Cited

U.S. PATENT DOCUMENTS

| | | | |
|---|---|---|---|
| 3,046,107 | 7/1962 | Nelson | 75/60 |
| 3,706,549 | 12/1962 | Knuppel | 75/60 |
| 3,976,473 | 8/1976 | Katayama | 75/49 |
| 3,990,888 | 11/1976 | Eriksson | 75/60 |
| 4,021,333 | 5/1977 | Johnsson | 75/60 |

FOREIGN PATENT DOCUMENTS

| | | | |
|---|---|---|---|
| 2047962 | 3/1971 | France | 75/60 |

*Primary Examiner*—P. D. Rosenberg
*Attorney, Agent, or Firm*—W. E. Lee, Jr.; L. G. Kastriner

[57] ABSTRACT

The nitrogen and oxygen content of low carbon steel made by the basic oxygen process is minimized by:

(a) introducing nitrogen-free fluid into the vessel before the nitrogen content of the melt has reached its minimum level, (b) adjusting the flow rate of the nitrogen-free fluid to maintain total off-gas flow rate at least equal to that which would have been produced without the nitrogen-free fluid at the time in the refining process when the nitrogen content of the melt reached its minimum level, and (c) the injection of nitrogen-free fluid throughout the remainder of the oxygen blow.

A preferred additional or alternatively separate step involves minimizing the nitrogen content of BOP steel by purging the vessel headspace with a nitrogen-free fluid prior to reblows.

20 Claims, 2 Drawing Figures

USE OF ARGON TO PREPARE LOW-CARBON STEELS BY THE BASIC OXYGEN PROCESS

This is a continuation of our prior U.S. application Ser. No. 758,408 filed Jan. 11, 1977, now abandoned.

BACKGROUND

This invention relates, in general, to a process for refining steel, and more specifically, to an improvement in the basic oxygen process wherein molten steel contained in a vessel is refined by top blowing oxygen into the melt, i.e., from above the melt surface.

The manufacture of steel by the basic oxygen process, also referred to as BOP or BOF process, is well known in the art. When low carbon steel is made by this process, it is often subject to contamination by atmospheric nitrogen. Such contamination tends to cause premature age hardening of the steel, which leads to strain-aging, poor surface properties and undesirable appearance of the final product.

The problem of nitrogen pickup during the manufacture of low-carbon steels has been addressed by the prior art. Glassman, in U.S. Pat. No. 3,769,000, describes a method for excluding nitrogen from the melt by placing a hood loosely over the mouth of the refining vessel. Nitrogen from ambient air is excluded by maintaining a curtain of carbon dioxide between the hood and the refining vessel. Pihlblad et al., in U.S. Pat. No. 3,307,937 disclose a method for excluding atmospheric nitrogen from the melt by adjusting the size of the opening through which gas flows out at the top of the vessel, thereby maintaining positive pressure in the vessel with respect to the ambient atmosphere, even at low carbon levels. Both of these approaches require modification of the BOP vessel which is expensive and cumbersome to utilize; consequently, neither has met with significant commercial success.

In addition to the potential for nitrogen contamination, a second disadvantage of the conventional basic oxygen process is the increasing quantity of oxygen that reacts with valuable metal as the carbon content of the melt decreases. Several U.S. patents disclose ways of diluting the oxygen with another gas in order to minimize the amount of oxygen that reacts with the metal. Such patents include Fulton et al. U.S. Pat. No. 3,649,246 and Ramachandran's U.S. Pat. Nos. 3,594,155 and 3,666,439. These patents deal only with the problem of increasing the degree to which the injected oxygen reacts with carbon rather than the metal. None are concerned with how one might utilize a diluent to minimize nitrogen pickup from the atmosphere during oxygen decarburization in the BOF.

OBJECTS

Accordingly, it is an object of the present invention to prevent contamination of molten ferrous metal with nitrogen during decarburization by top blowing with oxygen.

It is another object of this invention to produce low-carbon steels having a low nitrogen content as well as low oxygen content by the basic oxygen process.

It is still another object of this invention to minimize the amount of nitrogen-free fluid needed to produce low-carbon steel having a low nitrogen and low oxygen level.

SUMMARY OF THE INVENTION

The above and other objects, which will readily be apparent to those skilled in the art, are achieved by the present invention, one aspect of which comprises: in a process for the production of low-carbon steel by blowing oxygen into a ferrous melt contained in a vessel or zone from above the surface of said melt, the improvement comprising the production of steel having low nitrogen content by:

(a) introducing nitrogen-free fluid into the vessel before the nitrogen content in the melt has reached its minimum level, while continuing the blow with oxygen, (b) adjusting the flow rate of said nitrogen-free fluid so that the total off-gas flow rate from the vessel is maintained at least equal to that which would have been produced without said nitrogen-free fluid at the time in the refining process when the nitrogen content of the melt reached its minimum level, and (c) continuing the injection of said nitrogen-free fluid throughout the remainder of the oxygen blow.

During practice of the basic oxygen process it is common to interrupt the injection of oxygen into the melt and then reblow the melt with oxygen. Reblowing the melt is often accompanied by a significant increase in the dissolved nitrogen content of the melt. To prevent this nitrogen pickup when the oxygen flow has been interrupted the vessel should be purged by injection of a nitrogen-free fluid immediately prior to restarting the injection of oxygen. Thereafter the introduction of nitrogen-free fluid into the vessel is resumed before the nitrogen content in the melt has reached its minimum level, adjusted and continued as above.

The term "nitrogen-free fluid" as used herein is intended to mean any fluid, other than oxygen, substantially free of nitrogen or nitrogen-containing compounds. The term includes but is not limited to argon, helium, neon, krypton, xenon, carbon dioxide, carbon monoxide, steam, water, hydrogen, gaseous hydrocarbons such as methane and ethane, liquid hydrocarbons such as kerosene and n-heptane, and mixtures thereof. The preferred nitrogen-free fluid is argon.

The terms "low-carbon steel" and "low-nitrogen steel" as used herein are intended to include respectively steels having a carbon content no higher than about 0.10 percent, and steels having a nitrogen content no higher than about 0.005 percent (50 ppm).

The term "off-gas" is used to mean the gases which issue from the gas exit port or top opening of the steel refining vessel while oxygen or oxygen and one or more other gases are injected into the vessel in order to refine the ferrous melt.

The term "reblow" is used to mean a subsequent blowing of oxygen or oxygen mixed with other gas into a BOP vessel after the initial flow of the oxygen or oxygen-containing mixture has been stopped for any reason. It is possible to have more than one reblow per heat.

The preferred method of injecting the nitrogen-free fluid is to mix it with the oxygen stream; however alternate methods may also be used. The preferred amount of nitrogen-free fluid to use when purging the vessel prior to restarting the injection of oxygen is a volume of gas, measured at 70° F. and 1 atmosphere pressure, at least equal to one-half the vessel head space.

THE DRAWINGS

DETAILED DESCRIPTION OF THE INVENTION

Figure 1:
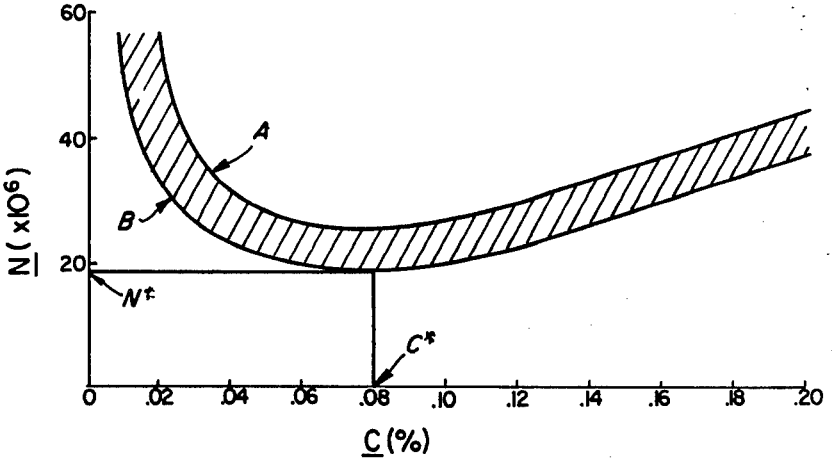
FIG. 1 is a graph illustrating the final nitrogen content N as a function of the final carbon content C of a series of heats of metal refined by prior art BOP practices in a typical commercial refining system without using the present invention. This figure illustrates how data obtained without practicing the invention is used to determine when nitrogen-free fluid injection should be started.

The band formed by curves A and B in FIG. 1 shows how the nitrogen content N of the melt varies with percent carbon C in the melt when the present invention is not practiced. Although all BOP systems exhibit curves shaped similarly to FIG. 1, the numerical relationship between N and C is specific to each BOP system and its manner of operation, and must be plotted from data obtained during actual production runs. The reasons for the variations from system to system are: variations in oxygen blowing rate, lance operating position, lance oxygen pressure, lance design, melt weight, vessel geometry, and so on. It can be seen that as the carbon content C decreases the nitrogen content N also decreases until a minimum is reached, at which point the nitrogen content begins to rise again.

The nitrogen content of the melt is used to determine when injection of the non-nitrogen fluid should begin in accordance with the present invention. However, since the nitrogen content is not often regularly measured, as is carbon content, and since nitrogen content is a function of carbon content for a given BOP vessel, as shown in FIG. 1, the carbon content can be used to determine the nitrogen content.

From FIG. 1 it can be seen that the nitrogen content of this particular system is at a minimum when the carbon content of the melt is approximately 0.08 percent.

Figure 2:
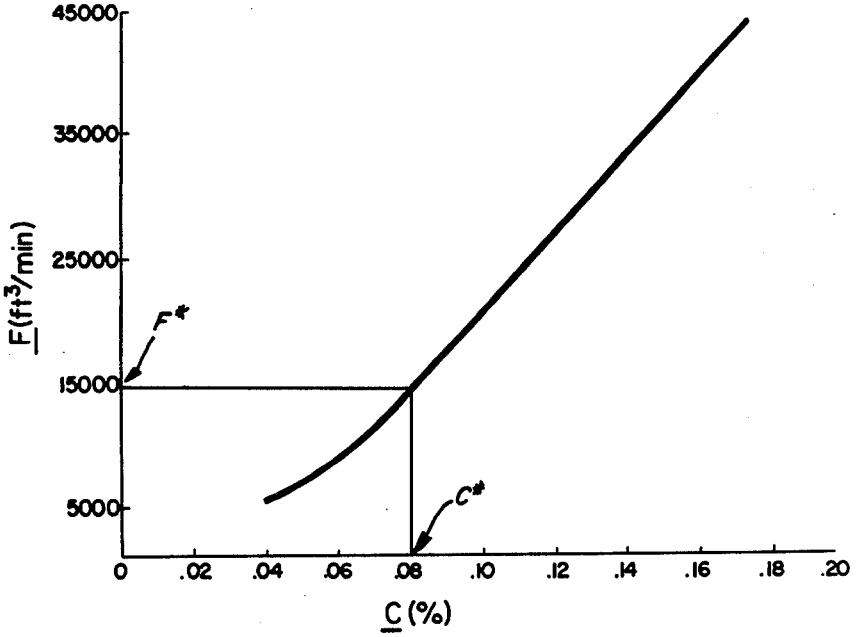
FIG. 2 is a graphic representation of the change in off-gas flow rate F as a function of carbon content C for same system for which data is shown in FIG. 1. This graph shows how the data, obtained without practicing the invention, is used to determine how much nitrogen-free fluid is to be injected.

FIG. 2 shows how the off-gas flow rate F varies with carbon content C for the given BOP refining system at a given oxygen blowing rate without using the method of the present invention. Approximate off-gas flow rates can be determined without a flow meter by preparing a graph of carbon content versus time, determining the rate at which carbon is removed by the slope of the plot, and calculating the off-gas rate by assuming that the carbon removed is converted to carbon monoxide and that this carbon monoxide constitutes all of the off-gas. As with FIG. 1, each BOP system will have its own curve for this relationship depending upon system characteristics and manner of operation.

While we do not wish to be tied to any particular theory, it is a hypothesis of this invention that nitrogen contamination in the basic oxygen process, occuring mainly during the latter stages of decarburization when the carbon content of the steel is low, is caused as follows. At high carbon levels the rate of carbon monoxide generation during the oxygen blow or decarburization period produces off-gas rates sufficient to prevent significant infiltration of the surrounding atmosphere into the vessel. In addition, at high carbon levels, the carbon monoxide boil is sufficient to sparge some of the nitrogen that may be dissolved in the steel. During the initial stages of decarburization therefore, the nitrogen level in the steel decreases, as shown in FIG. 1. Beyond a certain carbon level however, as the carbon content drops, the nitrogen content of the melt increases. It is believed that the reason for such increase is that as the carbon level drops, the rate of CO formation by the decarburization reaction and consequent off-gas evolution drops, making it possible for atmospheric nitrogen to enter the head space of the vessel and be absorbed by the melt. The oxygen jet helps carry the nitrogen down into the melt. Hence, as off-gas flow rate decreases, as shown in FIG. 2, infiltration of atmospheric nitrogen into the vessel is increased, and eventually a point is reached in which the nitrogen infiltrates at a rate sufficient to cause a net increase in the nitrogen content of the steel produced.

Practice of the present invention will now be described with reference to FIGS. 1 and 2. From actual operating data one obtains N*, the minimum nitrogen content attained during an oxygen blow for the particular system on which the invention is to be practiced. In FIG. 1 N* is about 19 to 25 parts per million. One then reads C*, the carbon content corresponding to N*. From FIG. 1 it can be seen that C* is 0.08%. Injection of the nitrogen-free fluid must be started no later than when the carbon content is C*. To determine the rate of injection of nitrogen-free fluid, one takes the carbon content at C* and reads on FIG. 2 the off-gas flow rate, F* corresponding to C*. F* is the value below which the off-gas flow rate must not be allowed to fall during the refining process. In accordance with this invention, the off-gas rate is maintained above this minimum value by maintaining the rate of injection of nitrogen-free fluid sufficient to maintain the total off-gas flow rate above F*.

In summary, from FIG. 1 one obtains the latest point in time at which to begin injecting the nitrogen-free fluid while from FIG. 2 one obtains the minimum amount of nitrogen-free fluid that needs to be added in accordance with the present invention in order to prevent contamination of the melt with atmospheric nitrogen.

In some cases, precise instantaneous measurement of neither the carbon content, nor the nitrogen content of the melt is available during decarburization. It is therefore more convenient to practice the invention by starting injection of the nitrogen-free fluid somewhat in advance of the time when the nitrogen content is equal to N* and the carbon content is C*. If a BOP system has no means for constantly monitoring the off-gas flow rate or means for controlling the off-gas rate by varying the amount of nitrogen-free fluid that is injected into the vessel, the invention can still be practiced by introducing the nitrogen-free fluid at a constant rate sufficient to maintain the total off-gas rate at least equal to F*.

It is not uncommon during practice of the basic oxygen process to interrupt the injecton of oxygen into the melt prior to achieving the final desired degree of decarburization. When this occurs it is necessary to reblow the melt. Similarly, it is also often necessary to reblow the melt even though the final desired carbon level has been reached, either because the temperature of the molten steel is too low, or because some other element or impurity is not at the desired level. Whatever the reason, reblowing of the molten steel is not at all uncommon. When a melt is reblown during conventional practice of the basic oxygen process it is often accompanied by a significant increase in dissolved nitrogen content. The amount of this increase will vary. Typical nitrogen pickup during conventional reblowing is in the range of 2 to 10 ppm, with increases of up to 15 or 20 ppm not uncommon. Further, if several reblows in succession are required, the final nitrogen level may be as much as 80 to 100 ppm higher than N* and 40 to 60 ppm higher than the maximum acceptable level for some grades of low-carbon, low-nitrogen steel.

It is believed that the reason for such high nitrogen pickup is that while refining is temporarily stopped, atmospheric nitrogen diffuses into the vapor or headspace of the vessel and is absorbed by the melt during the subsequent reblow. In accordance with this invention, nitrogen is removed from the vessel by purging the vessel with a nitrogen-free fluid, just prior to starting the reblow and by maintaining the off-gas flow rate no lower than F* during the reblow. While any amount of purging will be helpful it has been found that purging with a volume of gas (measured at 70° F. and atmospheric pressure) approximately equal to half the total volume of the headspace of the vessel is sufficient to minimize the nitrogen pickup by the steel during the reblow. Purging with less inert gas is likely to be insufficient, while purging with more is technically acceptable but uneconomical. It should be noted that if multiple reblows are required, the vessel must be purged prior to each reblow.

Argon is the preferred nitrogen-free fluid for use in the present invention. This gas has the advantages of being inert chemically, of being the least expensive and most abundant of the chemically inert gases, of being the least disruptive to the thermal balance in the vessel, and also of favorably affecting the reaction of oxygen with carbon by diluting the effluent carbon monoxide. Other nitrogen-free gases can also be used, as well as liquids which vaporize readily at steel refining temperatures. Examples of other nitrogen-free fluids include, but are not limited to: helium, neon, krypton, xenon, carbon dioxide, carbon monoxide, steam, water, hydrogen, methane, liquid hydrocarbons, gaseous hydrocarbons, or mixtures thereof, including mixtures with argon.

When using a flammable gas such as methane or hydrogen, special precautions should be taken to avoid forming an explosive mixture prior to injection into the refining vessel. The flammable gas will, of course, react with oxygen in the vessel. This reaction must be taken into account when calculating the amount of off-gas that will be produced for each quantity of flammable gas added.

In order to best attain the further benefits of minimizing the amount of metal oxidized, and of reducing the amount of oxygen dissolved in the melt, the preferred means for injecting the nitrogen-free fluid into the vessel is to mix it with the oxygen, if that can be accomplished without forming an explosive mixture. By using argon the possibility of creating an explosive mixture is entirely eliminated. By injecting the nitrogen-free fluid admixed with oxygen, the invention may be practiced on existing BOP systems with very little investment since there is no need to add new injection equipment. It is possible simply to meter the nitrogen-free fluid into the oxygen line at some point upstream of the oxygen lance. However, it is also possible to practice the invention by injecting the nitrogen-free fluid by a separate injecting lance, tuyere, or other injecting means located any place in the vessel, be it in the headspace, below the surface of the melt, or as a separate conduit within the oxygen lance.

One of the important benefits obtained by practicing the preferred method of the present invention is the production of steel having a low amount of oxygen dissolved in the melt, i.e. the dissolved oxygen content of the melt at the end of the blow period is generally lower than that which would obtain at the same melt carbon and temperature without the practice of the invention.

The following examples will serve to illustrate the practice of the present invention.

EXAMPLES

Several steel heats were refined by top blowing in a BOP refining system having the following characteristics

| | |
|---|---|
| Vessel volume | 5000 $ft^3$ |
| Vessel mouth area | 95 $ft^2$ |
| Total charge (pig iron and scrap metal) | 235 tons |
| Average amount of pig iron in charge | 162 tons |
| Average pig iron composition | 4.5% carbon<br>1.0% silicon<br>0.8% manganese |
| Nitrogen-free fluid | Argon gas |
| Oxygen blowing rate | |
| Without argon: | 20,000 $ft^3$/min (at 70° F and 1 atm) |
| with argon: | 16,500 $ft^3$/min (70° F and 1 atm) |
| Off-gas temperature | 2900° F |

The size of the lance limited the total flow rate of injected gas such that the oxygen blowing rate had to be reduced while argon was being injected. The invention is preferably practiced by maintaining a constant oxygen blowing rate throughout the entire heat.

The graphs relating nitrogen content and off-gas flow rate for this vessel with carbon content of the melt are shown in FIGS. 1 and 2. From the graphs it can be seen that the minimum nitrogen level, N*, occurs at a carbon content of approximately 0.08% and an off-gas rate of 15,000 $ft^3$/min (measured at 2900° F. and 1 atmosphere or pressure). Thus, in order to properly practice this invention, the latest point in time for introduction of nitrogen-free fluid into the vessel, is at a nitrogen content of about 19 to 25 parts per million or a carbon content of 0.08%. The argon must be injected at a rate sufficient to maintain the off-gas rate at 15,000 $ft^3$/min measured at 2900° F. and 1 atmosphere, or about 2300 $ft^3$/min measured at 70° F. and 1 atmosphere.

Argon was introduced into the BOP vessel via the oxygen lance by metering argon into the oxygen supply line upstream of the lance. Since a precise means to continuously measure the nitrogen or carbon content of the melt during the refining process was not available, the argon flow was begun when the carbon content was estimated to be between 0.10% and 0.15%. To maintain an off-gas rate of 15,000 $ft^3$/min at 2900° F., 3000 $ft^3$/min of argon measured at 70° F., or 19,000 $ft^3$/min at 2900° F., was injected. The extra gas was added to provide a safety factor in case all the argon was not heated to 2900° F. Some runs were performed with argon added at a constant rate as low as 2000 $ft^3$/min (at 70° F. and 1 atm). These runs also gave satisfactory results.

Table 1 shows the results obtained upon the first stoppage of oxygen or first turn down, for heats in which reblowing was not required prior to the time that argon was added to maintain the off-gas flow rate.

TABLE 1

NITROGEN CONTENT AT FIRST TURNDOWN

| Heat No: | 1 | 2 | 3 |
|---|---|---|---|
| Argon rate ($ft^3$/min at 70° F and 1 atm) | 0 | 2000 | 3000 |
| Duration of total oxygen blow (minutes) | 17 | 17 | 16 |
| Duration of argon injection (minutes) | 0 | 4.25 | 2.00 |
| Temperature (° F) | 2880 | 2935 | 2890 |
| Carbon content at first turndown (%) | 0.03 | 0.03 | 0.03 |
| Nitrogen content at first turndown (parts per million) | 33 | 20 | 24 |

The results in Table 1 show the lower nitrogen content obtained while practicing the invention in Heats No. 2 and 3 as compared with Heat No. 1, during which the invention was not practiced.

Table 2 illustrates the effect of purging the vessel prior to a reblow. In these heats argon was not introduced into the vessel prior to the first turn down. It was used to purge the vessel prior to the reblow and also added to the oxygen during each reblow. It is evident that purging the head space followed by addition of argon to the oxygen during the reblow essentially eliminates pickup of nitrogen even when the carbon content is as low as 0.03%. Consider, for example, Heat No. 1 where the purpose of the reblow was to raise the melt temperature. The carbon content was 0.03% both before and after the reblow — i.e., there was little or no carbon removal and hence there would, in the absence of argon, be little or no off-gas. Because the vessel was first purged with argon and then reblown with oxygen plus argon the total nitrogen pickup during the reblow was minus 1 ppm, i.e., the nitrogen level actually decreased. At this low carbon level one would anticipate a nitrogen pickup of at least 5 ppm if argon purging and argon addition during the reblow had not been practiced.

Heat No. 4 is an example of a heat where multiple reblows were required. Argon purging was used prior to each reblow and argon was added to the oxygen during each reblow. Again it is evident from the results shown in Table 2 that the addition of argon in accordance with this invention resulted in a cumulative nitrogen pickup of minus 3 ppm (i.e., a nitrogen decrease) after four consecutive reblows. Normally, at these low carbon levels in the absence of argon addition, one would anticipate a minimum cumulative nitrogen pickup of about 20 ppm after 4 reblows, and a total pickup of 40 to 60 ppm would not be unusual.

Table 2

Argon Purge Before Reblows and Argon Injection During Reblows

| Heat No. | Reblow No. | Purge Volume Prior to Reblow (SCF) | Argon Rate During Reblow, (SCFM) | Reblow Duration, (Seconds) | Initial C Content, (%) | Final C Content, (%) | Initial N Content, (PPM) | Final N Content, (PPM) | Final Temperature (° F) |
|---|---|---|---|---|---|---|---|---|---|
| 1* | 1 | 5000 | 3000 | 60 | 0.03 | 0.03 | 33 | 32 | 2925 |
| 4 | 1 | 5000 | 3000 | 90 | 0.31 | .12 | 29 | 26 | 2920 |
| | 2 | 6250 | 3000 | 50 | 0.12 | .04 | 26 | 28 | 2850 |
| | 3 | 5000 | 3000 | 20 | 0.04 | — | 28 | — | 2830 |
| | 4 | 5000 | 3000 | 50 | — | .03 | — | 26 | 2850 |
| 5 | 1 | 5000 | 3200 | 120 | .57 | .20 | 18 | 19 | 2860 |
| | 2 | 5000 | 3500 | 120 | .20 | .07 | 19 | 20 | 2925 |

*This heat is a continuation of Heat No. 1 from Table 1

Table 3 illustrates the results of practicing the invention when it is necessary to reblow a heat after argon addition to maintain the minimum off-gas flow rate prior to first turn down. In Heat No. 6, argon flow was initiated at a rate of 2000 SCFM 390 seconds prior to the first turn down. At turn down the temperature was 2950° F., carbon 0.13% and nitrogen 16 ppm. The vessel was then purged with 2500 SCF of argon and reblown for 60 seconds with 16,500 SCFM oxygen and 3000 SCFM argon. After 60 seconds the temperature was 2860° F., carbon was 0.07% and nitrogen was 19 ppm. The vessel was again purged with 2500 SCF argon and again reblown for 60 seconds with 3000 SCFM argon and 16,500 SCFM oxygen, and at turn down the temperature was 2910° F., carbon was 0.04% and nitrogen, 18 ppm. Total nitrogen pickup during the two reblows was 2 ppm. The heat was then tapped.

Heat No. 7 is similar to Heat No. 6 except that only one reblow was required, and the nitrogen pickup was minus 2 ppm, i.e., the nitrogen level decreased.

Table 3

Argon Used Before First Turndown and For Reblows

| Heat No. | Reblow No. | Purge volume prior to reblow (SCF) | Argon Rate During $O_2$ Blow (SCFM) | $O_2$ + Argon Duration (Seconds) | Before C Content (%) | After C Content (%) | Before N Content (PPM) | After N Content (PPM) | After Blow Temp. (° F) |
|---|---|---|---|---|---|---|---|---|---|
| 6 | — | — | 2000 | 390 | — | 0.13 | — | 16 | 2950 |
| | 1 | 2500 | 3000 | 60 | 0.13 | .07 | 16 | 19 | 2860 |
| | 2 | 2500 | 3000 | 60 | 0.07 | .04 | 19 | 18 | 2910 |
| 7 | — | — | 2800 | 225 | — | 0.06 | — | 24 | 2900 |
| | 1 | 2500 | 3000 | 60 | .06 | 0.04 | 24 | 22 | 2930 |

What is claimed is:

1. In a process for the production of low-carbon steel by blowing oxygen into a ferrous melt contained in a vessel from above the surface of said melt, the improvement comprising:

(a) introducing nitrogen-free fluid into the vessel before the nitrogen content of the melt has reached its minimum level, while continuing to blow with oxygen, (b) adjusting the flow of said nitrogen-free fluid so that the total off-gas flow rate from the vessel is maintained at least equal to that which would have been produced without said nitrogen-free fluid at the time in the refining process when the nitrogen content of the melt reached its minimum level, and (c) continuing the injection of said nitrogen-free fluid substantially throughout the remainder of the oxygen blow.

2. The process of claim 1 wherein the nitrogen-free fluid is argon.

3. The process of claim 1 wherein the nitrogen-free fluid is injected admixed with the oxygen.

4. The process of claim 1 wherein the nitrogen-free fluid is injected at a constant rate at least equal to the off-gas rate obtained at the time in the refining process when the nitrogen content of the melt has achieved its minimum level.

5. The process of claim 1 wherein the steel produced has a carbon content below 0.10% and a nitrogen content below 50 ppm.

6. In a process for the production of low carbon steel by blowing oxygen into a melt contained in a vessel from above the surface of said melt wherein the oxygen blow has been interrupted before the nitrogen content of the melt has achieved its minimum level the improvement comprising:

(a) purging said vessel headspace by injection of a nitrogen-free fluid immediately prior to restarting the injection of oxygen, and after restarting the injection of oxygen, (b) introducing nitrogen-free fluid before the nitrogen content in the melt has substantially achieved its minimum, (c) adjusting the flow of said nitrogen-free fluid so that the total off-gas flow rate from the vessel is maintained at least equal to that which would have been produced without said nitrogen-free fluid, at the time in the refining process when the nitrogen content of the melt reached its minimum level, and (d) continuing the injection of said nitrogen-free fluid substantially throughout the remainder of the oxygen blow.

7. The process of claim 6 wherein the nitrogen-free fluid is argon.

8. The process of claim 6 wherein the nitrogen-free fluid is injected admixed with the oxygen.

9. The process of claim 6 wherein the purge contains a volume of gas measured at 70° F. and 1 atmosphere substantially equal to half the total vessel headspace.

10. The process of claim 6 wherein the nitrogen-free fluid is injected during the oxygen reblowing at a constant rate at least equal to the off-gas rate obtained at the time in the process when the nitrogen content of the melt has achieved its minimum.

11. The process of claim 6 wherein the steel produced has a carbon content below 0.10% and a nitrogen content below 50 ppm.

12. The process of claim 1 wherein the blow has been interrupted during the injection of nitrogen-free fluid comprising the additional steps of:

(d) purging said vessel headspace by injection of a nitrogen-free fluid immediately prior to restarting the injection of oxygen, and after restarting the injection of oxygen, (e) resuming injection of said nitrogen-free fluid before the nitrogen content in the melt has substantially achieved its minimum, (f) adjusting the flow of said nitrogen-free fluid so that the total off-gas flow rate from the vessel is maintained at least equal to that which would have been produced without said nitrogen-free fluid at the time in the refining process when the nitrogen content of the melt reached its minimum level, and (g) continuing the injection of said nitrogen-free fluid substantially throughout the remainder of the oxygen blow.

13. The process of claim 12 wherein the nitrogen-free fluid is argon.

14. The process of claim 12 wherein the nitrogen-free fluid is injected admixed with the oxygen.

15. The process of claim 12 wherein the purge contains a volume of gas measured at 70° F. and 1 atmosphere substantially equal to half the total vessel headspace.

16. The process of claim 12 wherein the nitrogen-free fluid is injected during the oxygen blow and reblow at a constant rate at least equal to the off-gas rate obtained at the time in the refining process when the nitrogen content of the melt has achieved its minimum.

17. In a process for the production of low carbon steel by blowing oxygen into a melt contained in a vessel from above the surface of said melt wherein the oxygen blow has been interrupted, the improvement comprising purging said vessel headspace by injection of a nitrogen-free fluid immediately prior to restarting the injection of oxygen.

18. The process of claim 17 wherein the nitrogen-free fluid is argon.

19. The process of claim 17 wherein the purge contains a volume of gas measured at 70° F. and 1 atmosphere substantially equal to half the total vessel headspace.

20. The process of claim 17 wherein the steel produced has a carbon content below 0.10% and a nitrogen content below 50 ppm.

* * * * *

UNITED STATES PATENT AND TRADEMARK OFFICE

CERTIFICATE OF CORRECTION

PATENT NO. : 4149878
DATED : April 17, 1979
INVENTOR(S) : Henry D. Thokar et.al.

It is certified that error appears in the above-identified patent and that said Letters Patent are hereby corrected as shown below:

In the Specification, column 2, line 10 reading: "nitrogen content by"
should read: --nitrogen content as well as low oxygen content by --.

Signed and Sealed this

Seventh Day of August 1979

[SEAL]

Attest:

Attesting Officer

LUTRELLE F. PARKER
Acting Commissioner of Patents and Trademarks